US005953823A

United States Patent [19]

Huang

[11] Patent Number: 5,953,823

[45] Date of Patent: Sep. 21, 1999

[54] STRUCTURE OF AN ADJUSTABLE FINGER SUPPORT FOR SCISSORS

[76] Inventor: Chien-Che Huang, P.O. Box 82-144, Taiwan, Taiwan

[21] Appl. No.: 09/078,675

[22] Filed: May 14, 1998

[51] Int. Cl.[6] ..... B26B 13/20

[52] U.S. Cl. ..... 30/232; 30/291

[58] Field of Search ..... 30/232, 231, 291, 30/298; 76/106.5

[56] References Cited

U.S. PATENT DOCUMENTS 5,027,514 7/1991 Pracht ..... 30/232

*Primary Examiner*—Douglas D. Watts
*Attorney, Agent, or Firm*—A & J

[57] ABSTRACT

Scissors includes a pair of blades, a pivot for connecting the blades to each other in articulated manner, a first handle fixedly connected to one of the blades and having an end provided with a finger loop, the finger loop having a outer side formed with a groove, a second handle fixedly connected to another one of the blades, a finger support adjustably fitted in the groove of the finger loop of the first handle, and means for preventing the finger support to detach from the groove of the finger loop of the first handle, whereby the finger support can be easily pulled out of the first handle for receiving a ring or little finger as desired.

3 Claims, 3 Drawing Sheets

STRUCTURE OF AN ADJUSTABLE FINGER SUPPORT FOR SCISSORS

BACKGROUND OF THE INVENTION

1. Field of the Invention

This invention is related to a structure of an adjustable finger support for scissors which can be pulled out for supporting a finger as desired.

2. Description of the Prior Art

The conventional scissors includes two scissor blades, a pivot for connecting the scissor blades to each other in articulated manner, and two scissor handles connected to corresponding scissor blades. Each of the scissor blades acts as a first-class lever. The sharpened edges of the scissor blades form two wedges that cut with great force into a material from opposite directions and as they meet, they part the material sideways. However, such scissors are only designed for ordinary cutting purposes, but not suitable for heavy duty cutting. Hence, scissors with a finger support have been proposed and developed to achieve an ergonomically favorable handling of the scissors for heavy duty cutting purposes. As shown in FIG. 4, the conventional scissors with a finger support generally includes a pair of blades 30, a pair of handles 31, a pivot for connecting the blades 30 to each other in articulated manner, and a finger support 32 integral with one of the handles 31. However, as the finger support 32 protrudes out of the scissors to form a hook-like member, it will be very inconvenient to carry and stow when not in use. Therefore, those who need scissors for various cutting purposes are used to preparing these two kinds of scissors thus causing much inconvenience and wasting money.

Therefore, it is an object of the present invention to provide scissors having a finger support which can be pulled out for receiving a finger as desired.

SUMMARY OF THE INVENTION

The present invention has been accomplished to provide scissors with an adjustable finger support. According to the preferred embodiment of the present invention, scissors includes a pair of blades, a pivot for connecting the blades to each other in articulated manner, a first handle fixedly connected to one of the blades and having an end provided with a finger loop, the finger loop having a outer side formed with a groove, a second handle fixedly connected to another one of the blades, a finger support adjustably fitted in the groove of the finger loop of the first handle, and means for preventing the finger support to detach from the groove of the finger loop of the first handle. The finger support can be easily pulled out of the first handle for receiving a finger as desired thereby making it suitable for use in heavy duty cutting purposes.

It is the primary object of the present invention to provide a structure of an adjustable finger support for scissors which can be pulled out for supporting a finger as desired.

It is another object of the present invention to provide a structure of an adjustable finger support for scissors which can be pushed into the finger loop when not in use.

It is still another object of the present invention to provide a structure of an adjustable finger support for scissors which can achieve an ergonomically favorable handling of the scissors for heavy duty cutting.

It is still another object of the present invention to provide a structure of an adjustable finger support for scissors which can facilitate the operation of scissors for heavy duty cutting.

It is a further object of the present invention to provide a structure of an adjustable finger support for scissors which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
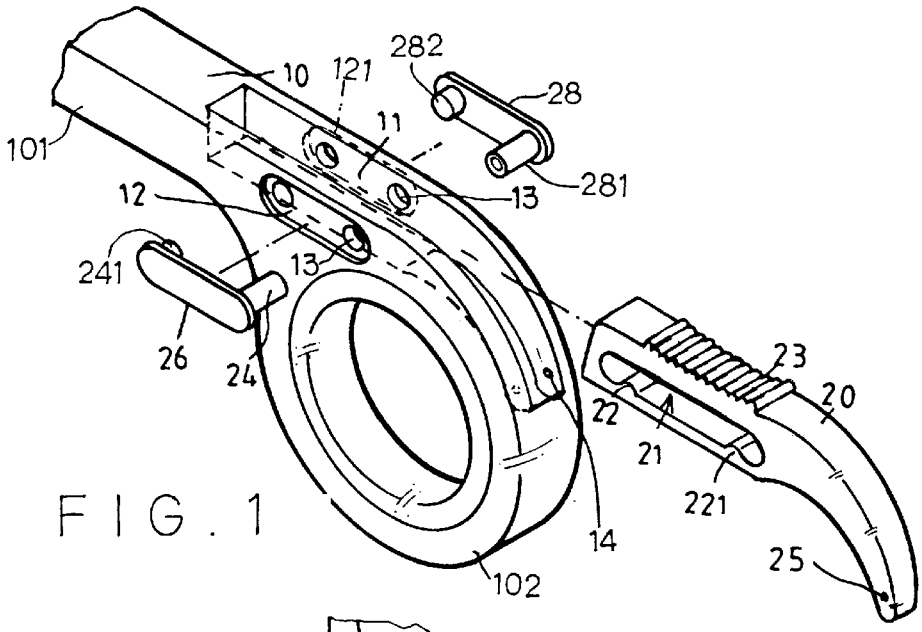
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
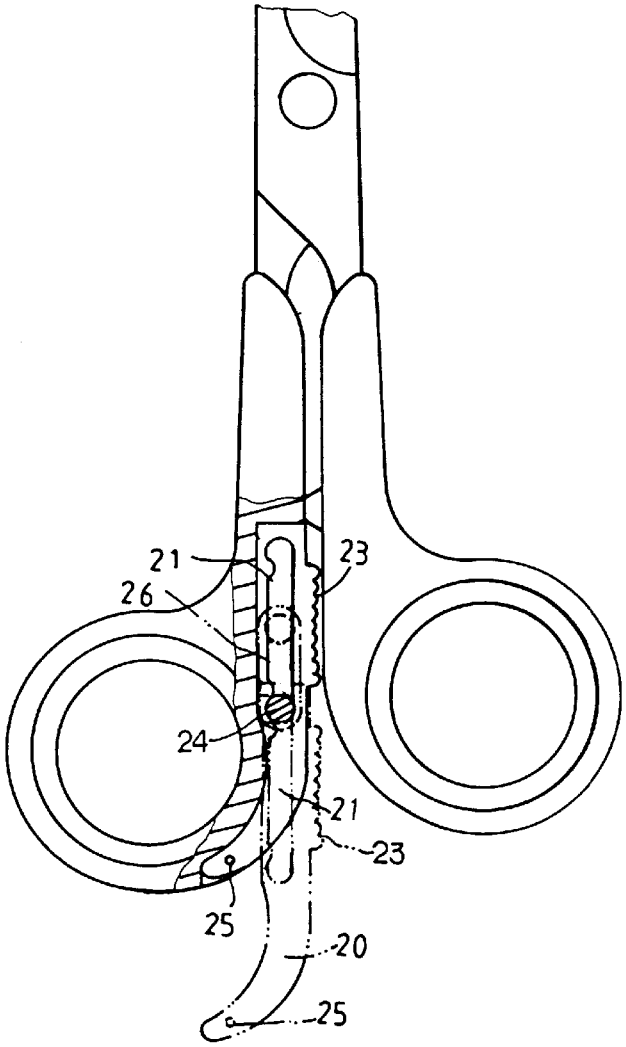
FIG. 2 illustrates the working principle of the present invention.
Figure 3:
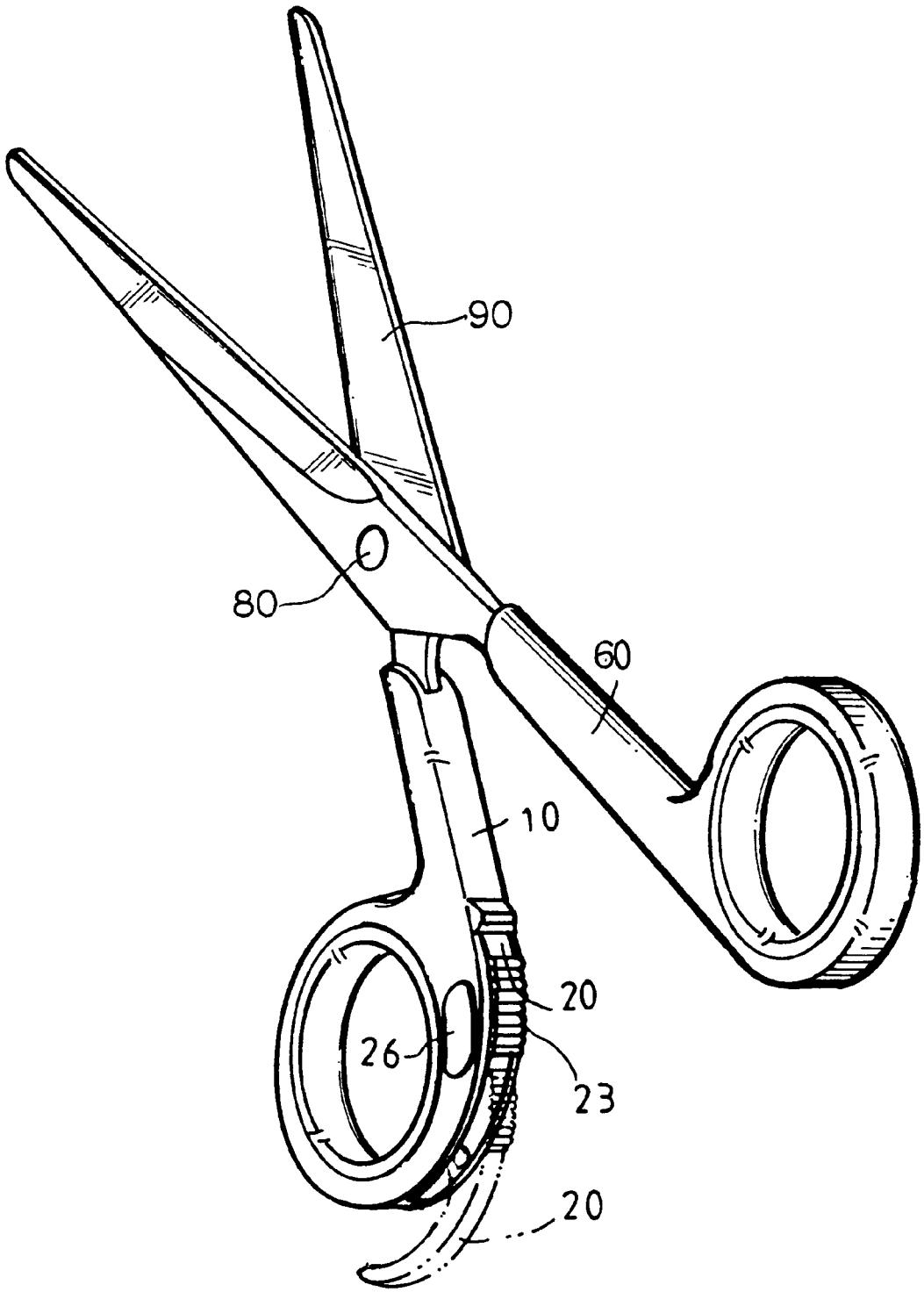
FIG. 3 is a perspective view of the present invention.
Figure 4:
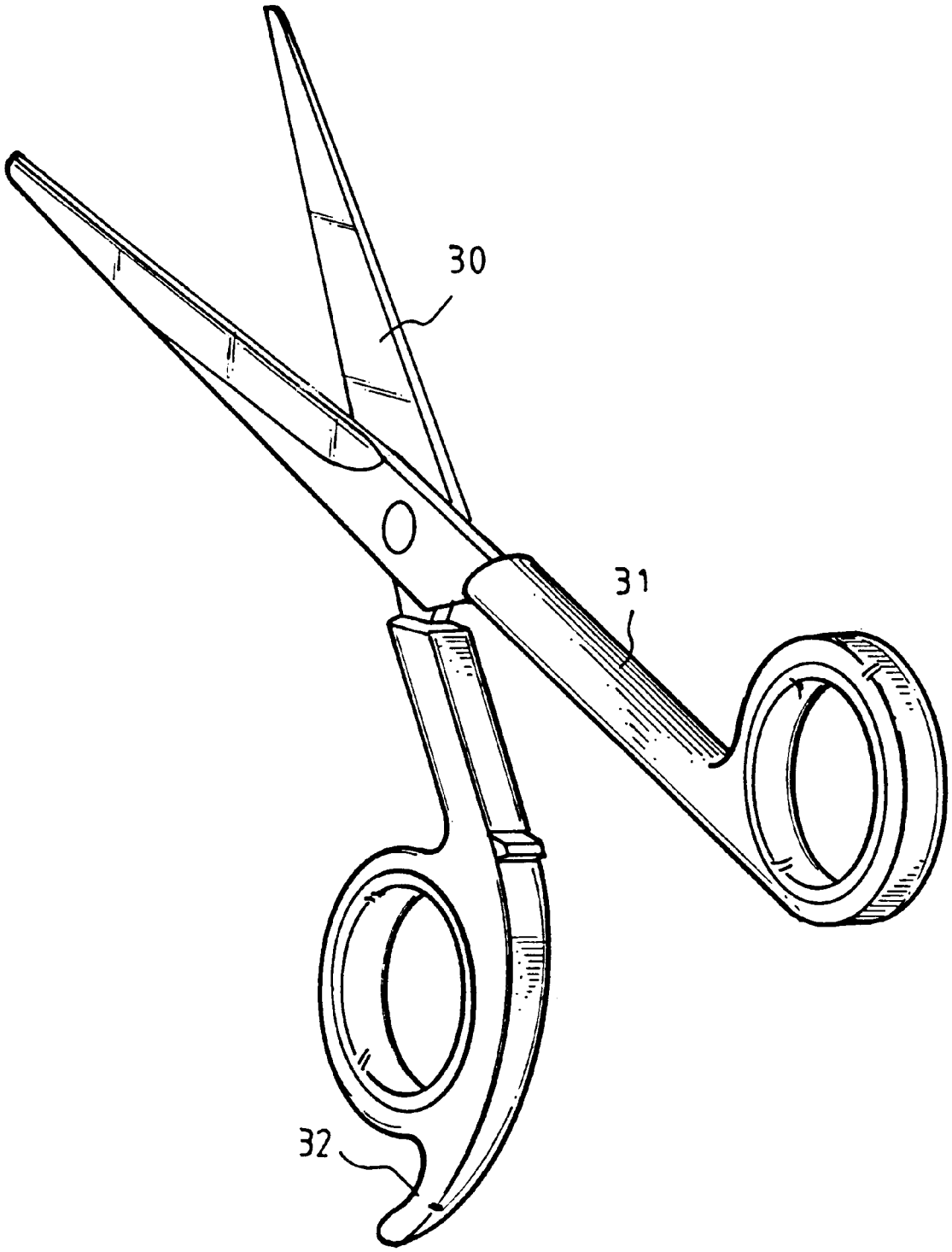
FIG. 4 is a perspective view of a pair of prior art scissors.

With reference to the drawings and in particular to FIGS. 1, 2 and 3 thereof, the scissors according to the present invention generally comprises a pair of blades 90, a pivot 80 for connecting the blades 90 to each other in articulated manner, a first handle 10 fixedly connected to one of the blades 90, a second handle 60 fixedly connected to another one of the blades 90, and a finger support 20 adjustably mounted in the first handle 10.

The first handle 10 includes an elongated portion 101 and a finger loop 102 provided with at the end thereof. The finger loop 102 is formed with a dovetail groove 11 extending along the elongated portion 101 and the finger loop 102. Two opposite sides of the elongated portion 101 of the first handle 10 are formed with two recesses 12 and 121 each having two through holes 13 in communication with the dovetail groove 11. The lower end of the dovetail groove 11 has two aligned cavities 14 at two opposite inner sides thereof. The finger support 20 is shaped and dimensioned to fit into the dovetail groove 121. The finger support 20 is formed with an elongated slot 21 having a first and second protuberances 22 and 221 each close to an end of the elongated slot 21. The top of the finger support 20 is provided with a plurality of raised lines 23 for facilitating the manual operation of the finger support 20. The lower end of the finger support 20 has two projections 25 at two sides adapted to receive in the cavities 14 of the dovetail groove 11. A first cover 26 provided with a long pin 24 at an end and a short pin 241 at another end is mounted in the recess 12 of the first handle 10 so that the long pin 24 is inserted through the hole 13 of the recess 12 into the elongated slot 21 of the finger support 20 and the short pin 241 is fitted in the hole 13 of the recess 12 and not going into the elongated slot 21 of the finger support 20. A second cover 28 provided with a tubular portion 281 at an end and a short pin 282 at another end so that when the second cover 28 is arranged in the second recess 121 of the first handle 10, the tubular portion 281 of the second cover 28 will go through the holes 13 of the second recess 121 into the elongated slot 21 of the finger support 20 to receive the long pin 24 and the short pin 282 is fitted in the hole 13 of the recess 121 and not going into the elongated slot 21 of the finger support 20, thereby providing positioning of the finger support 20 and preventing the finger support 20 from detaching from the groove 121 of the first handle 10. The projections 25 of the finger support 20 will be received in the cavities 14 of the groove 121 when the finger support 20 is completely pushed into the groove 121 thus keeping the finger support 20 in a fixed position when not in use.

When in use, it is only necessary to pull the finger support 20 outwardly from the first handle 10 so that the finger support 23 can be used for receiving a finger as desired. As the finger support 23 is pulled out of the first handle 10, the tubular portion 281 of the second cover 28 will go through the two protuberances 22 and 221 to contact the rear end of the elongated slot 21 of the finger support 20 thereby keeping the finger support 20 at the extended position. When not in use, it is only necessary to push the finger support 20 into the groove 121 so that the tubular portion 281 of the second cover 28 will go through the two protuberances 22 and 221 to the front end of the elongatged slot 21 of the finger support 20 thus keeping the finger support 20 at the contracted position. The covers 26 and 28 can be used for mounting a trademark label, decoration or the like.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. Scissors comprising:

a pair of blades;

a pivot for connecting said blades to each other in articulated fashion;

a first handle fixedly connected to one of said blades and having an end provided with a finger loop, said finger loop having a outer side formed with a groove;

a second handle fixedly connected to another one of said blades;

a finger support adjustably fitted in said groove of said finger loop of said first handle; and means for preventing said finger support to detach from said groove of said finger loop of said first handle, said means including a first cover mounted on one side of said first handle and provided with a pin extending through said groove and a second cover mounted on another side of said second handle and provided with a tubular portion extending through said groove to receive said pin.

2. Scissors as claimed in claim 1, wherein said first handle has two sides formed with two recesses dimensioned to received said first and second covers.

3. Scissors as claimed in claim 1, wherein said finger support is formed with an elongated slot in which are fitted said tubular portion of said second cover.

* * * * *